US006644833B1

(12) United States Patent
Fu

(10) Patent No.: US 6,644,833 B1
(45) Date of Patent: Nov. 11, 2003

(54) ILLUMINATING NOVELTY CLEANSING BAR

(76) Inventor: Li Fu, 34/81 Bath Road, Kirrawee 2232, New South Wales (AU)

( * ) Notice: Subject to any disclaimer, the term of this patent is extended or adjusted under 35 U.S.C. 154(b) by 0 days.

(21) Appl. No.: 10/105,838

(22) Filed: Mar. 25, 2002

(51) Int. Cl.[7] ..... F21V 33/00

(52) U.S. Cl. ..... 362/253; 362/157; 362/189; 362/806

(58) Field of Search ..... 362/253, 234, 362/802, 800, 806, 157, 189

(56) References Cited

U.S. PATENT DOCUMENTS 5,971,827 A * 10/1999 Lee et al. ..... 446/81

6,116,753 A * 9/2000 Tsang ..... 362/253

* cited by examiner

*Primary Examiner*—Laura K. Tso
(74) *Attorney, Agent, or Firm*—Michael I Kroll

(57) ABSTRACT

The present invention 10 discloses a translucent, light illuminating cleansing bar 14 having an electronic lighting apparatus or container 16 embedded within an inner object 18 suspended within a cleansing bar 14. The object 18 within the cleansing bar 14 can be of a variety of items such as toys, key chains, dolls or any novelty item. The electronic illuminating container 16 consists of a motion switch 20, LED 22, battery 24 and integrated circuit 26. The motion switch 20 activates the circuit and energizes the LED 22 in a predetermined program, flashes the LED sequence until a timer turns it off when the program is complete. Each subsequent occurrence when the motion switch 20 is closed, will activate the program, powering the LED 22 in the repetitive flashing sequence.

8 Claims, 9 Drawing Sheets

ILLUMINATING NOVELTY CLEANSING BAR

BACKGROUND OF THE INVENTION

Field of the Invention

The present invention relates generally to soap and, more specifically, to an illuminating novelty cleansing bar, suitable for children, consisting of an outer housing of translucent soap containing a novelty item embedded within that is also translucent and contains an illumination device within. The illuminating device consists of an led, battery, motion switch and integrated circuit board. The motion switch, when activated, closes, completing the circuit, the battery energizes the LED in a predetermined time program. The LED flashes in a sequence and turns off when it has completed its program. Each subsequent occurrence (when the motion switch is closed) activates the program, powering the LED repeating the cycle again. Once the cleansing bar is depleted, the user is left with an illuminating novelty item or toy. The device is designed so no soap gets wasted and adds an interest into the using of the soap bar. Light projects out from the soap, provided by the inner illumination device making it extremely attractive to children and promotes cleanliness and good health habits.

SUMMARY OF THE PRESENT INVENTION

The present invention discloses a translucent, light illuminating cleansing bar having an electronic lighting apparatus or container embedded within an inner object suspended within the cleansing bar. The object within the cleansing bar can be of a variety of items such as toys, key chains, dolls or any novelty item. The electronic illuminating container consists of a motion switch, LED, battery and integrated circuit. The motion switch activates the circuit and energizes the LED in a predetermined program, flashes the LED sequence until a timer turns it off when the program is complete. Each subsequent occurrence when the motion switch is closed, will activate the program, powering the LED in the repetitive flashing sequence.

A primary object of the present invention is to provide a translucent cleansing bar (soap) with a translucent novelty item within.

Another object of the present invention is to provide a translucent cleansing bar (soap) with a translucent novelty item within that contains an illuminating container.

Yet another object of the present invention is to provide a translucent cleansing bar (soap) that having an illuminating container within consisting of a battery, LEDS, motion switch and integrated circuit board.

Still yet another object of the present invention is to provide a translucent cleansing bar that the motion switch activates the circuit and energizes the LED in a predetermined program of a flashing sequence until a timer turns it off.

Another object of the present invention is to provide a translucent cleansing bar that each subsequent occurrence of motion activates the program, powering the LEDS to repeat the sequence.

Yet another object of the present invention is to provide a translucent cleansing bar that is appealing and fun to children and promotes cleanliness and good health habits.

Still yet another object of the present invention is to provide a translucent cleansing bar that when the soap portion of the device is completed, a novelty item or usable toy is revealed, encouraging the user to use all the soap surrounding the item within.

Additional objects of the present invention will appear as the description proceeds.

The present invention overcomes the shortcomings of the prior art by providing a translucent cleansing bar (soap) with a translucent novelty item within that contains an illuminating container. The illuminating container within consists of a battery, LEDS, motion switch and integrated circuit board. Also having a translucent cleansing bar that the motion switch activates the circuit and energizes the LED in a predetermined program of flashing sequence until a timer turns it off Also to provide a translucent cleansing bar that each subsequent occurrence of motion activates the program, powering the LEDS to repeat the sequence. And to provide a translucent cleansing bar that is appealing and fun to children and promotes cleanliness and good health habits. Also to provide a translucent cleansing bar that when the soap portion of the device is completed, a novelty item or usable toy is revealed, encouraging the user to use all of the soap surrounding the item within.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
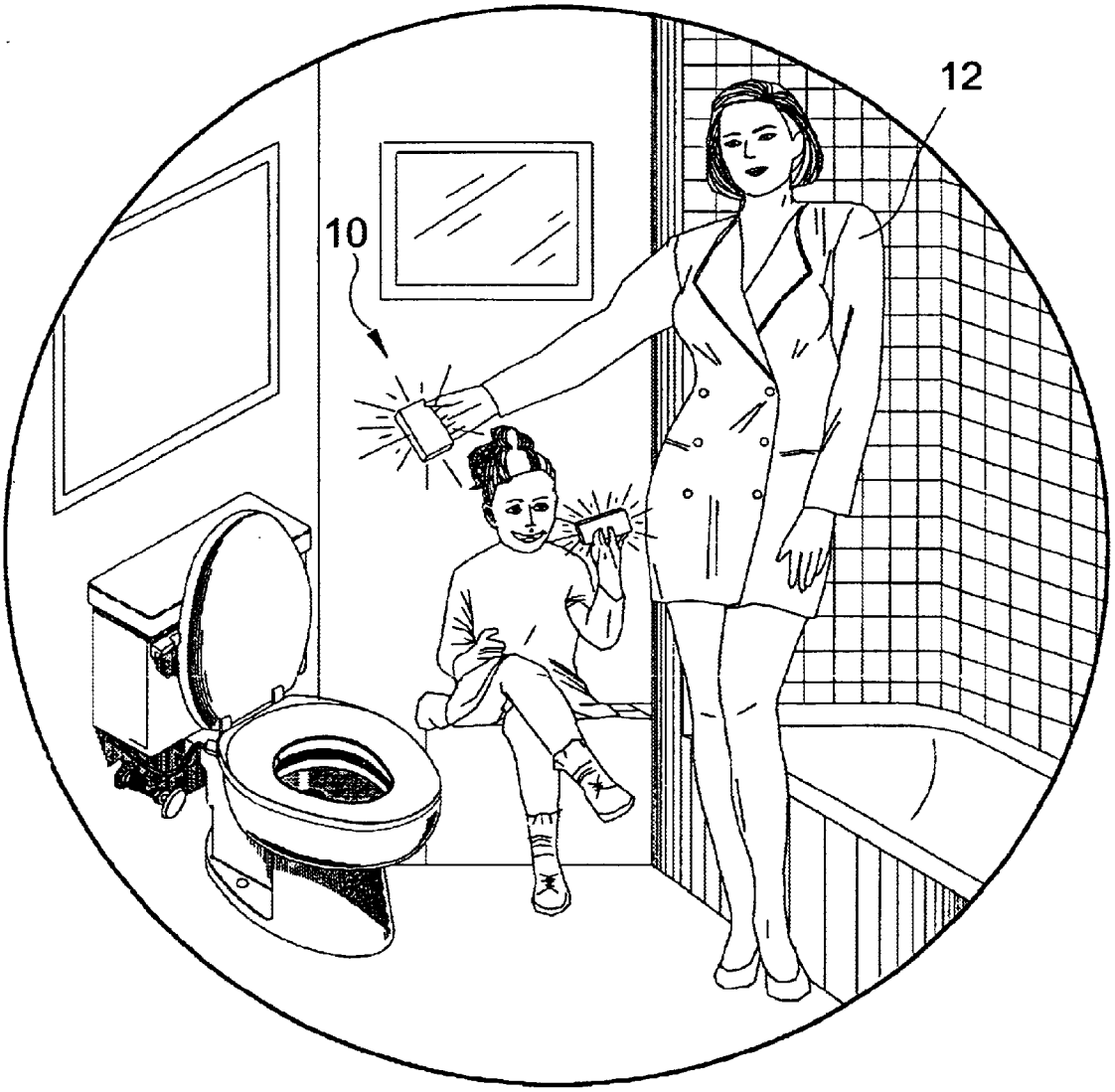
FIG. 1 is an illustrative view of the present invention.

With regard to reference numerals used, the following numbering is used throughout the drawings.

10 present invention
12 user
14 translucent cleansing bar
16 electronic illumination container
18 translucent novelty item

20 motion switch
22 LED
24 battery
26 integrated circuit
28 depleted translucent cleansing bar
30 toy animal
32 key chain
34 favorite pet
36 sports novelty item
38 a super ball

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For a definition of the complete scope of the invention, the reader is directed to the appended claims.

Turning to FIG. 1, shown therein is an illustrative view of the present invention 10 in the hands of a user 12. The present invention 10, a translucent, light illuminating cleansing bar has an electronic lighting apparatus embedded within an object suspended within the cleansing bar. The object within the cleansing bar can be of a variety of items such as toys, key chains, dolls or any novelty item desirable to the public.

Figure 2:
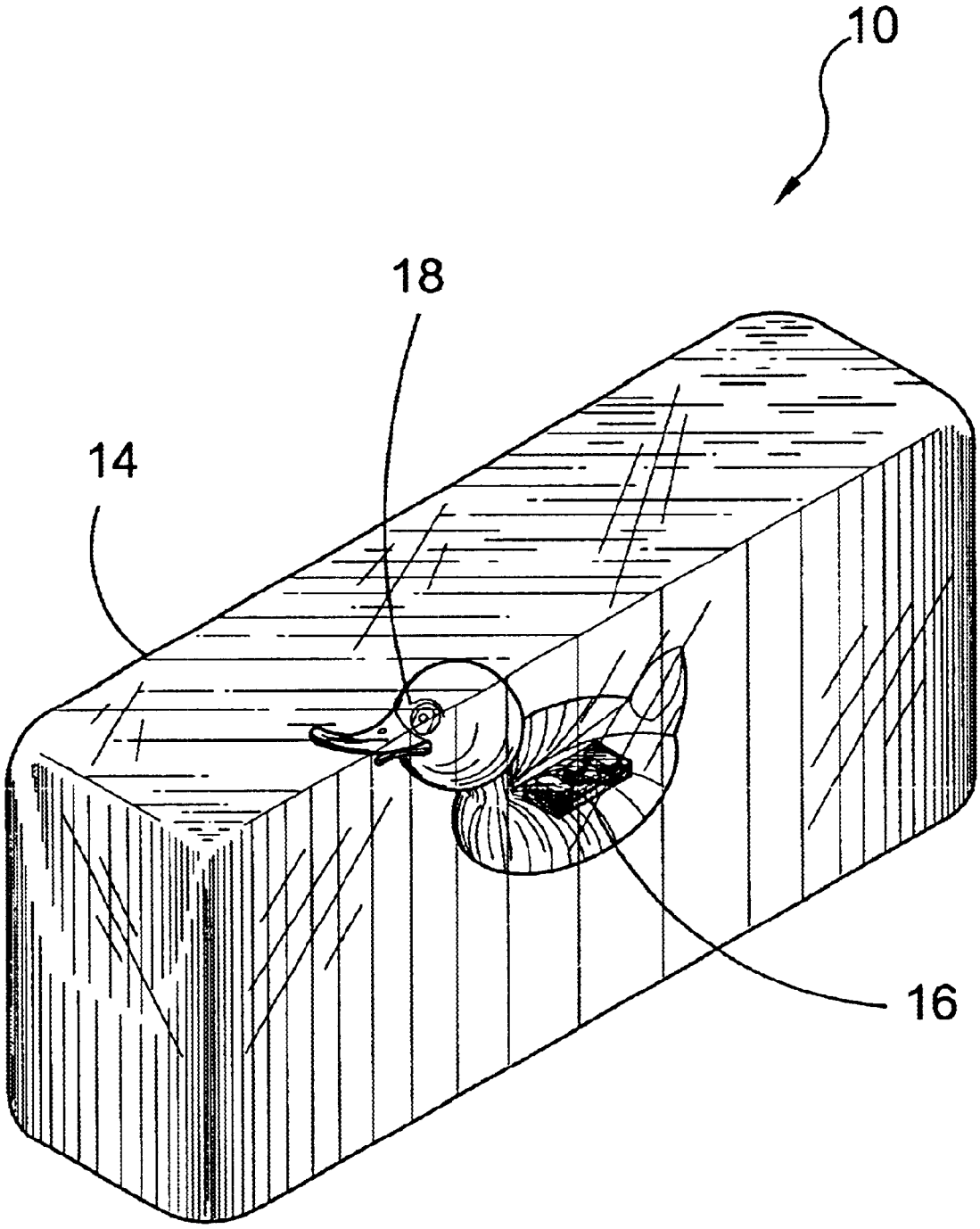
FIG. 2 is a perspective view of the present invention.

Turning to FIG. 2, shown therein is an illustrative view of the present invention 10. The present invention 10 discloses a translucent, light illuminating cleansing bar 14 or bar of soap having an electronic lighting apparatus or container 16 embedded within an inner object 18, being a toy animal in this example, suspended within the cleansing bar 14. The object 18 within the cleansing bar 14 can be of a variety of items such as toys, key chains, dolls or any novelty item. The electronic illuminating container 16 consists of a motion switch, LED, battery and an integrated circuit. The motion switch activates the integrated circuit and energizes the LED in a predetermined program, flashes the LED sequence until a timer turns it off when the program is complete. Each subsequent occurrence when the motion switch is closed, will activate the program, powering the LED in the repetitive flashing sequence.

Figure 3:
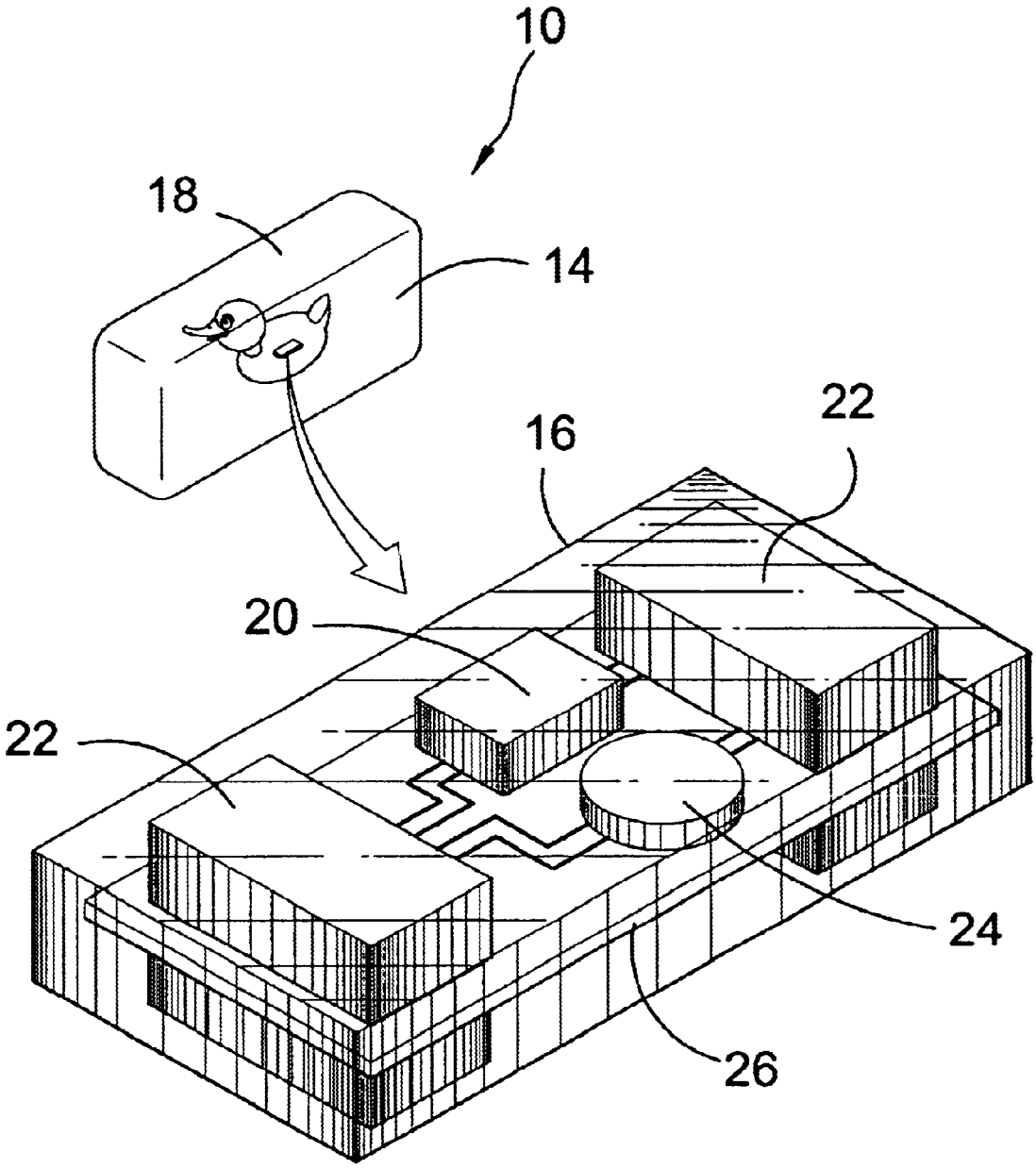
FIG. 3 is a perspective view of the present invention.

Turning to FIG. 3, shown therein is a perspective view of the present invention 10. The above illustration shows a translucent, light illuminating cleansing bar 14 having an electronic lighting apparatus 16 embedded within an inner object 18 suspended within the cleansing bar 14. A motion switch 20, at least one LED (light emitting diode) 22, battery 24 and integrated circuit 26 are contained within the electronic illuminating container 16. The motion switch 20, or motion detector, activates the normally off circuit 26 when the cleansing bar 14 is moved and energizes the LED 22 in a predetermined program for a predetermined length of time and flashes the LED 22 sequence until a timer turns it off when the program is complete. Each subsequent occurrence when the motion switch 20 is closed or activated, will activate the program, powering the LED 22 to repeat the flashing sequence.

Figure 4:
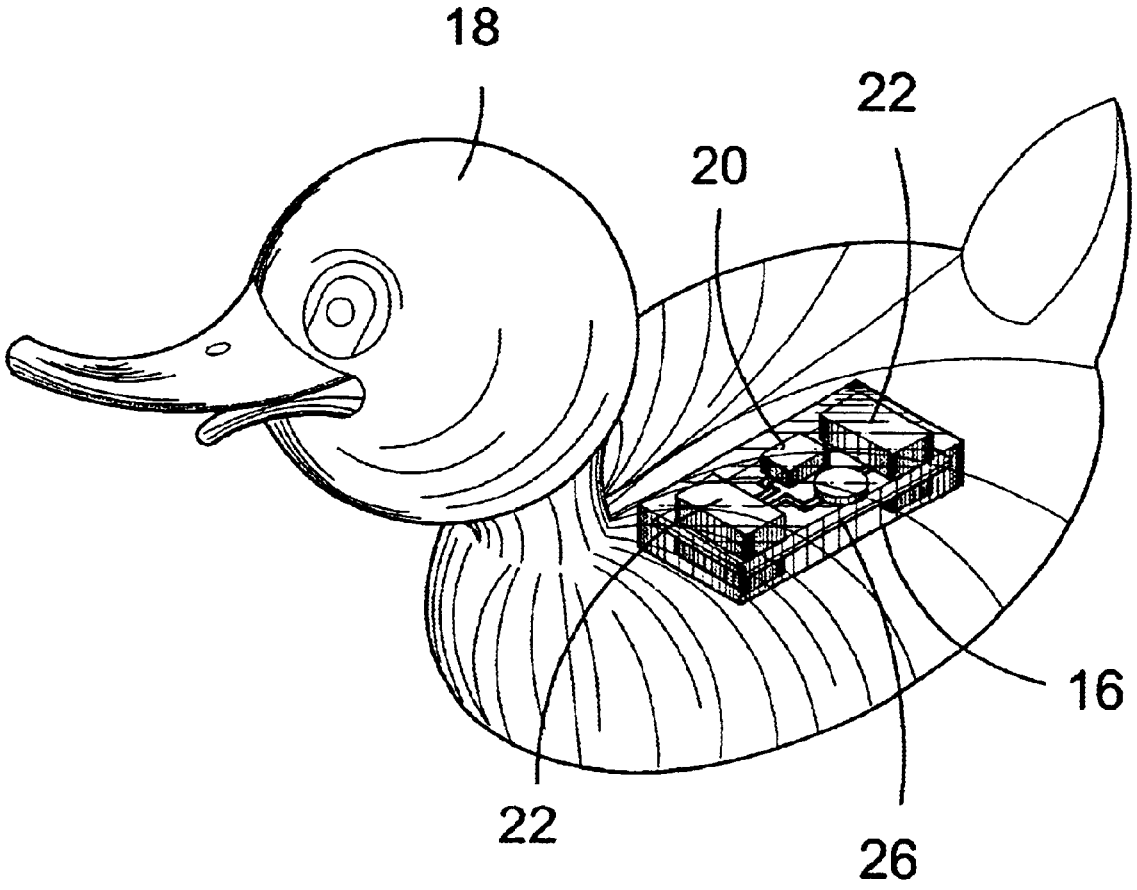
FIG. 4 is a perspective view of the present invention.

Turning to FIG. 4, shown therein is a perspective view of the inner object or translucent novelty item 18 of the present invention. The above illustration shows a translucent, light illuminating apparatus 16 of the present invention 10. A motion switch 20, LED 22, battery 24 and integrated circuit 26 are contained within the electronic illuminating container. The motion switch 20 activates the circuit and power energizes the LED 22 in a predetermined program as previously disclosed.

Figure 5:
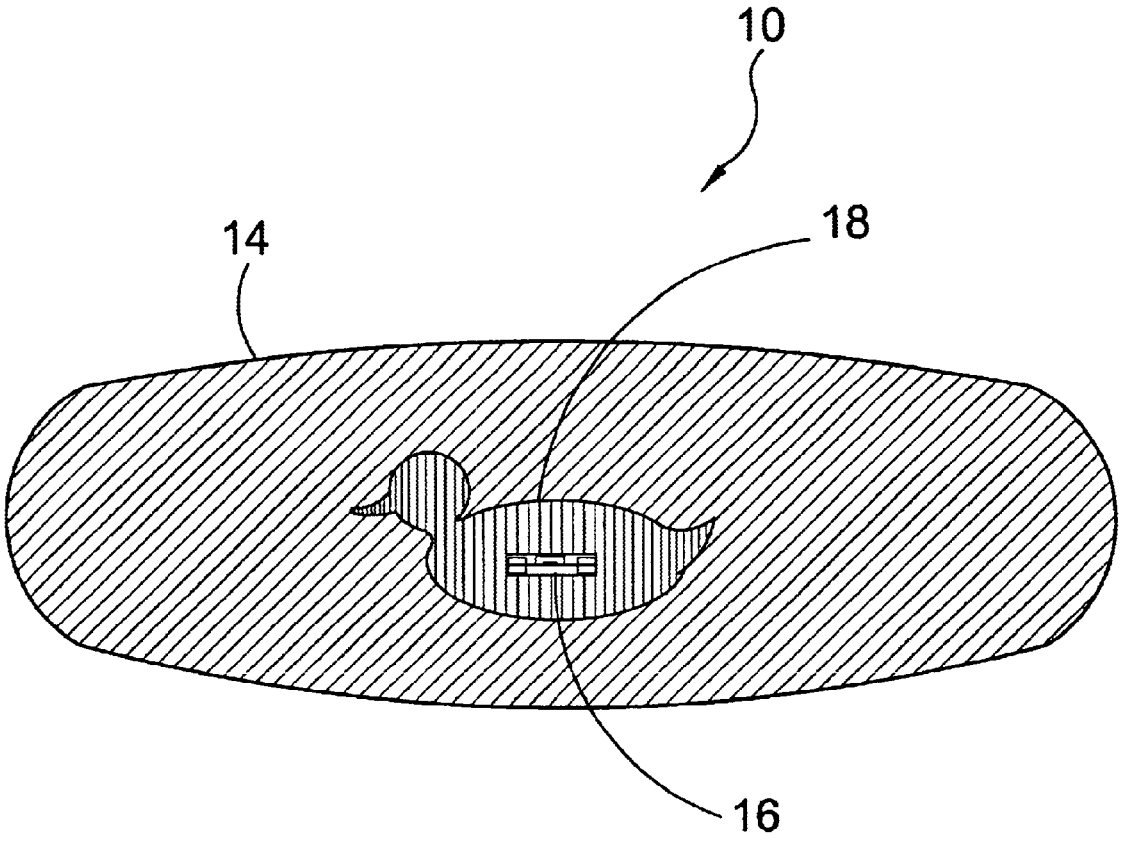
FIG. 5 is a sectional view of the present invention.

Turning to FIG. 5, shown therein is a sectional view of the present invention 10 disclosing a translucent, light illuminating cleansing bar 14 having an electronic lighting apparatus 16 embedded within an object suspended within the cleansing bar 14. The inner object 18 within the cleansing bar can be of a variety of items such as toys, key chains, dolls or any novelty item. The electronic illuminating container 16 consists of a motion switch, LED, battery and integrated circuit as previously disclosed.

Figure 6:
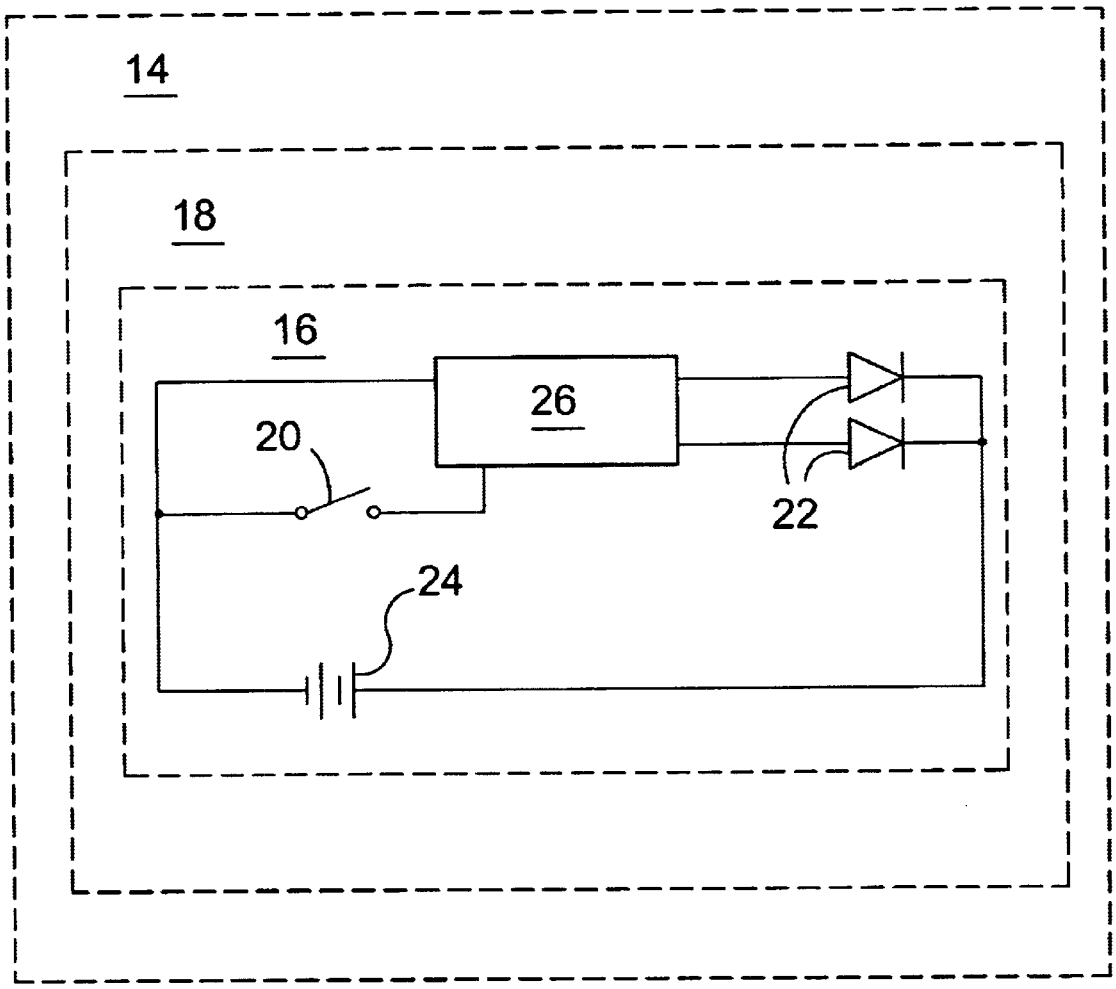
FIG. 6 is a schematic diagram of the present invention.

Turning to FIG. 6, shown therein is a schematic diagram of the present invention. The schematic diagram shows the illumination components, contained within the illumination container 16. The container 16 is positioned within a novelty item 18 and suspended within a translucent bar of soap 14. Shown are a motion switch 20, an integrated circuit 26, a battery 24, and a pair of LED's 22.

Figure 7:
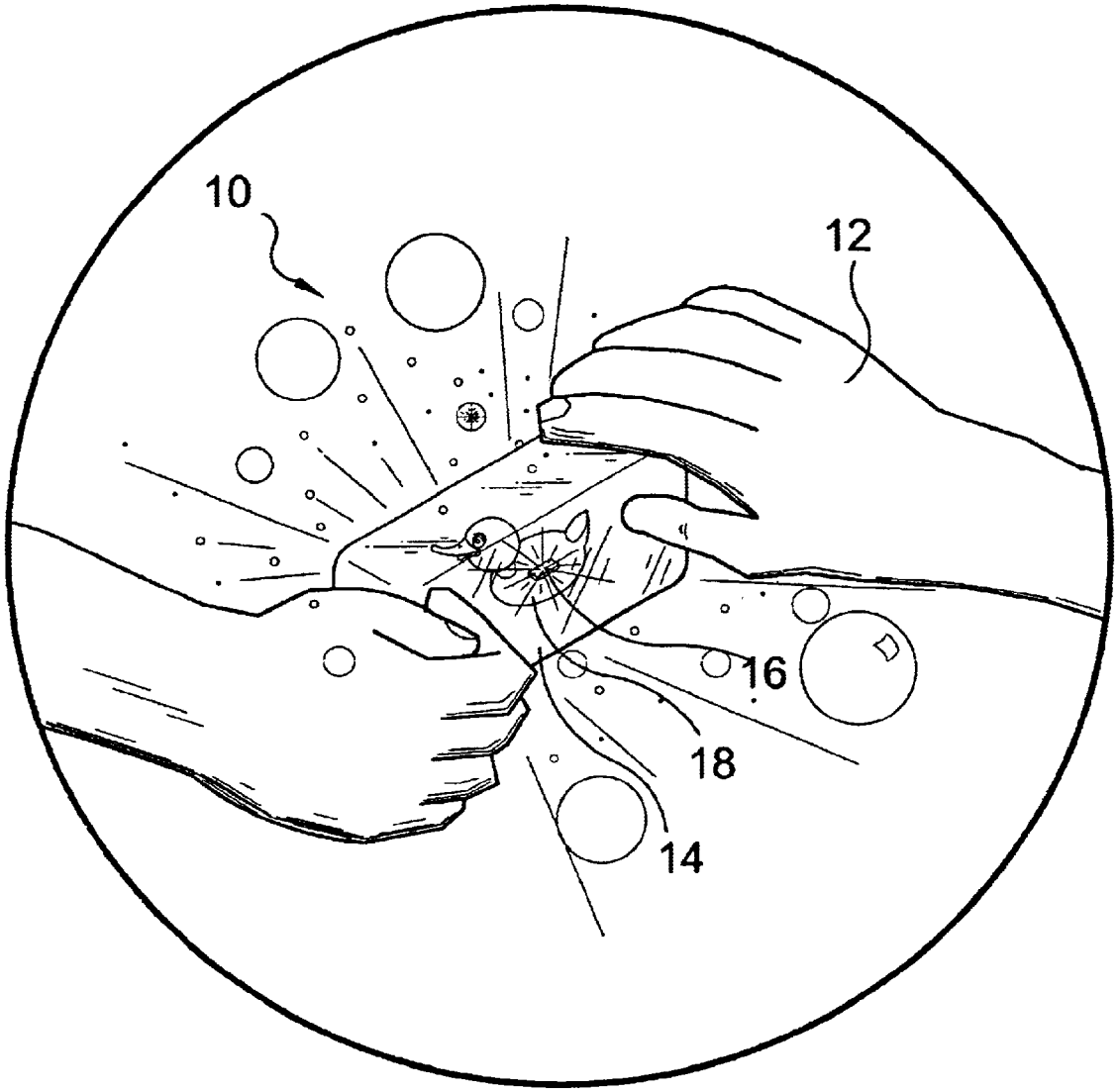
FIG. 7 is an illustrative view of the present invention in use.

Turning to FIG. 7, shown therein is an illustrative view of the present invention 10 in use in the hands of a user 12. The present invention provides an illuminating soap device that within the bar of translucent soap 14, a novelty item 18 which may also be translucent, containing an electronic container 16. A motion switch within the container 16 provides a circuit that activates the present invention 10 for the amusement of children and adults alike.

Figure 8:
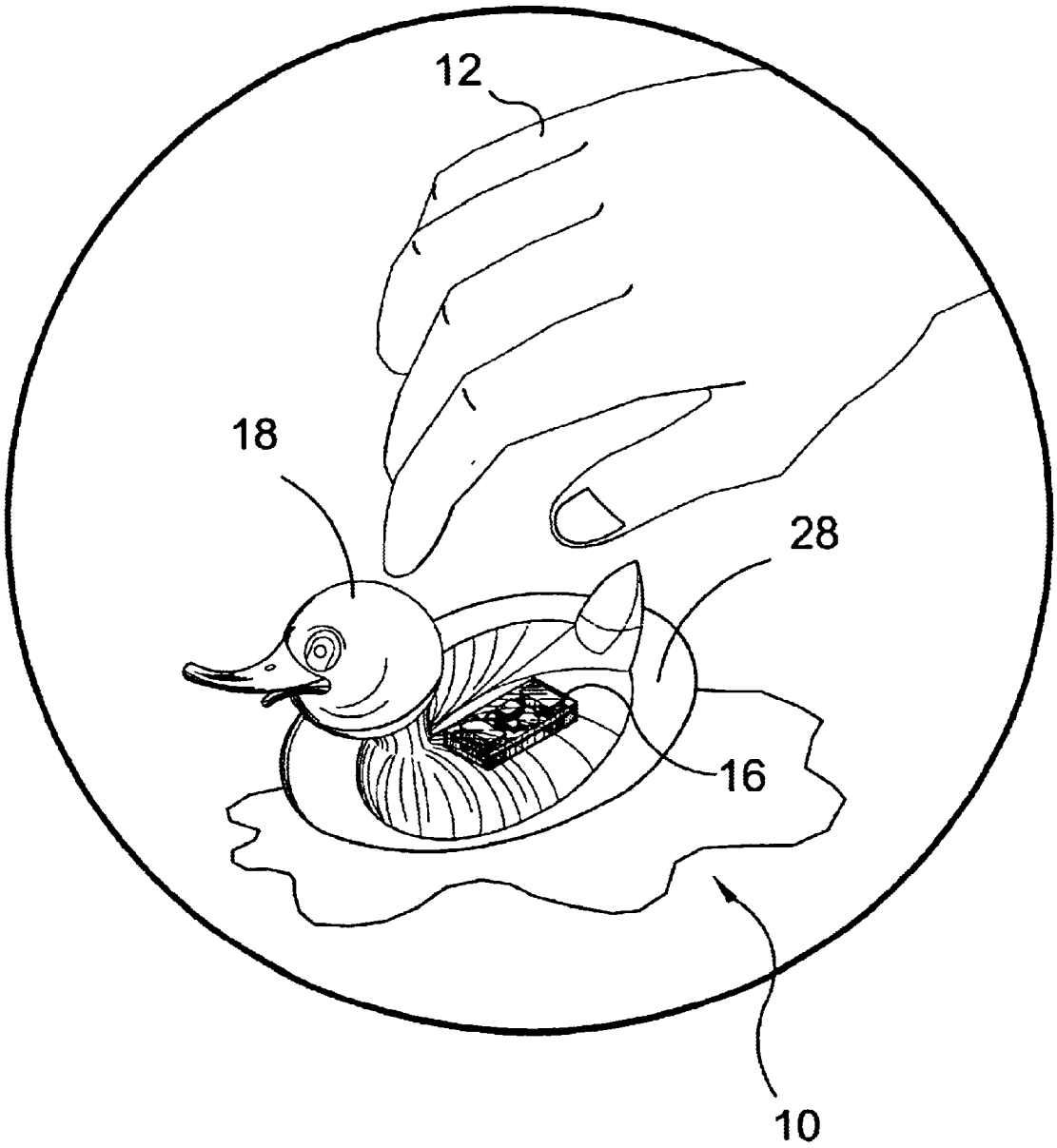
FIG. 8 is an illustrative view of the present invention in use.

Turning to FIG. 8, shown therein is an illustrative view of the present invention 10 in use in the hands of a user 12 showing a depleted bar of soap 28. The present invention provides a soap device that within the bar of translucent soap 14, is a novelty item 18, containing an electronic illuminating container 16. A motion switch within the container 16 provides a circuit that activates the device for the amusement of children and adults alike. When the soap bar is depleted 28, the novelty item 18 within is revealed.

Figure 9:
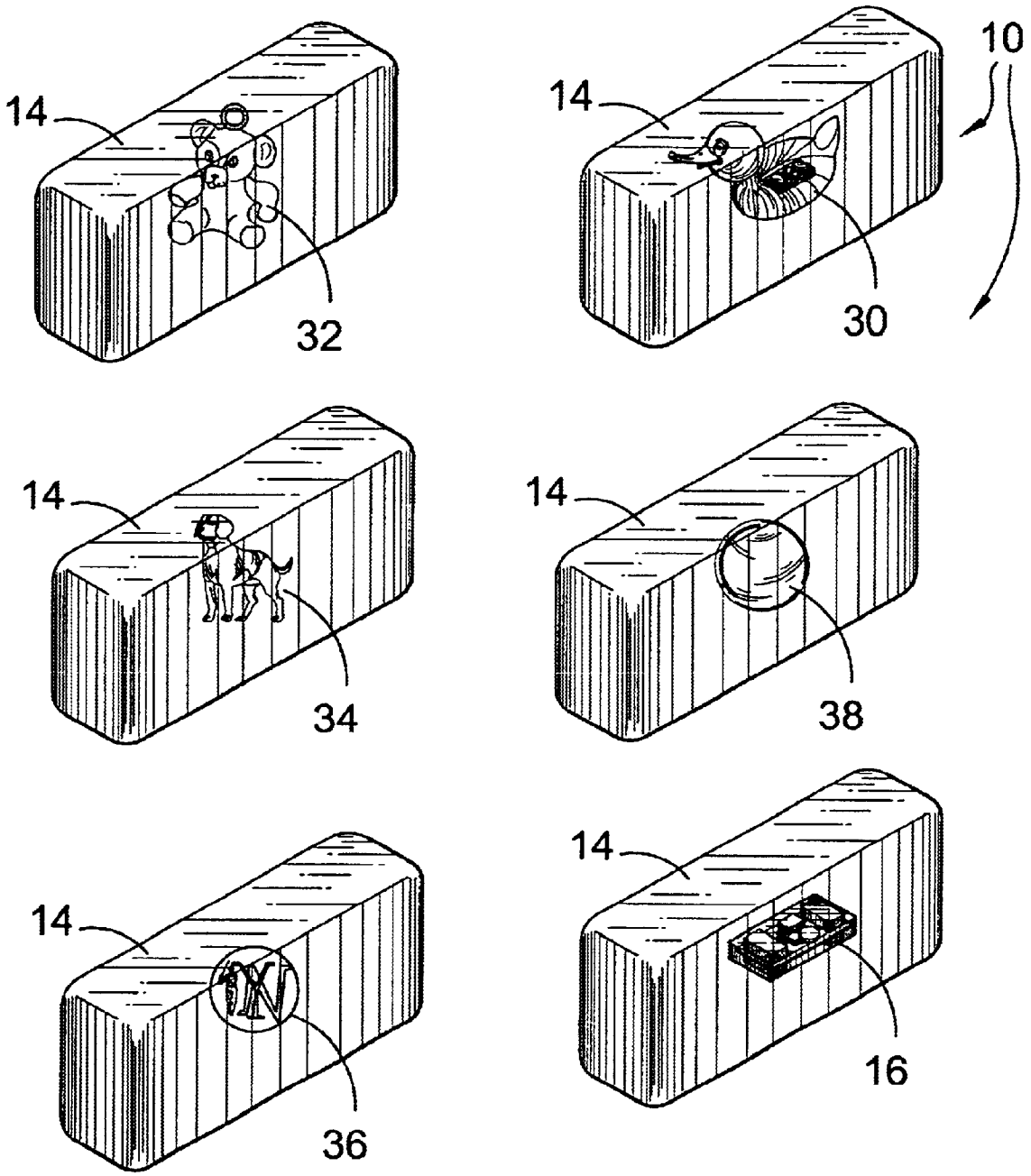
FIG. 9 is an illustrative view of the present invention in use.

Turning to FIG. 9, shown therein is an illustrative view of the present invention 10 in use. The present invention can be provided consisting of many different novelty items within, all having electronic containers within. The shape of the bar of soap 14 may also vary according to design. Shown are the illumination container 16, a toy animal 30, a key chain 32, a favorite pet 34, a sports novelty item 36, and a super ball 38.

I claim:

1. An apparatus for illuminating a cleansing bar, comprising:

a) a translucent cleansing bar;

b) a toy disposed internal said translucent cleansing bar;

c) an electronic illuminating means disposed inside of said toy for illuminating said toy when the translucent cleansing bar is moved; and, d) said toy remaining after said cleansing bar is exhausted.

2. The apparatus of claim 1, wherein said translucent cleansing bar is sized for use by humans.

3. The apparatus of claim 2, wherein said translucent cleansing bar further comprises soap.

4. The apparatus of claim 3, wherein said toy is translucent.

5. The apparatus of claim 4, wherein said electronic illuminating means comprises:

a) an integrated circuit;

b) a timer disposed in said integrated circuit;

c) a motion detector disposed in said integrated circuit to permit the integrated circuit to be activated when said translucent cleansing bar is moved;

d) at least one light emitting diode disposed in said integrated circuit; and, e) a power supply disposed in said integrated circuit for activating the integrated circuit and energizing the light emitted diode in a flashing sequence until a predetermined program is complete.

6. The apparatus of claim 5, wherein said integrated circuit is normally off.

7. The apparatus of claim 6, further comprising a pair of light emitting diodes.

8. The apparatus of claim 7, wherein said power supply is a battery.

* * * * *